United States Patent [19]

Koch

[11] Patent Number: 4,947,501

[45] Date of Patent: Aug. 14, 1990

[54] METHOD AND APPARATUS FOR CONTINUOUS WET-IN-WET PROCESSING

[75] Inventor: Werner Koch, Wald-Michelbach, Fed. Rep. of Germany

[73] Assignee: Bruckner Apparatebau GmbH

[21] Appl. No.: 228,013

[22] Filed: Aug. 3, 1988

[30] Foreign Application Priority Data

Aug. 4, 1987 [DE] Fed. Rep. of Germany ..... 3725831

[51] Int. Cl.[5] ..... D06B 3/18

[52] U.S. Cl. ..... 8/151; 8/158; 68/9; 68/207; 118/694

[58] Field of Search ..... 8/158, 151; 6/9, 207; 118/423, 694

[56] References Cited

U.S. PATENT DOCUMENTS

| | | | |
|---|---|---|---|
| 2,887,087 | 5/1959 | Jones | 118/694 |
| 3,280,602 | 10/1966 | Schiffer | 68/207 X |
| 3,916,651 | 11/1975 | Carruthers | 68/207 X |
| 3,948,490 | 4/1976 | Troope | 8/158 X |
| 4,620,338 | 11/1986 | von der Eltz | 8/158 X |

*Primary Examiner*—Frankie L. Stinson

*Attorney, Agent, or Firm*—Thomas & Kennedy

[57] ABSTRACT

The invention relates to a method and apparatus for continuous wet-in-wet processing of a length of material in which a continuously regulated additional dosaging occurs using a treatment both of low content, the quantity of treatment liquor added being always exactly the quantity which has just been carried off by the outgoing length of material. In this way the bath concentration can be kept constant with a high degree of accuracy and the balance in the bath is also achieved quickly.

6 Claims, 1 Drawing Sheet

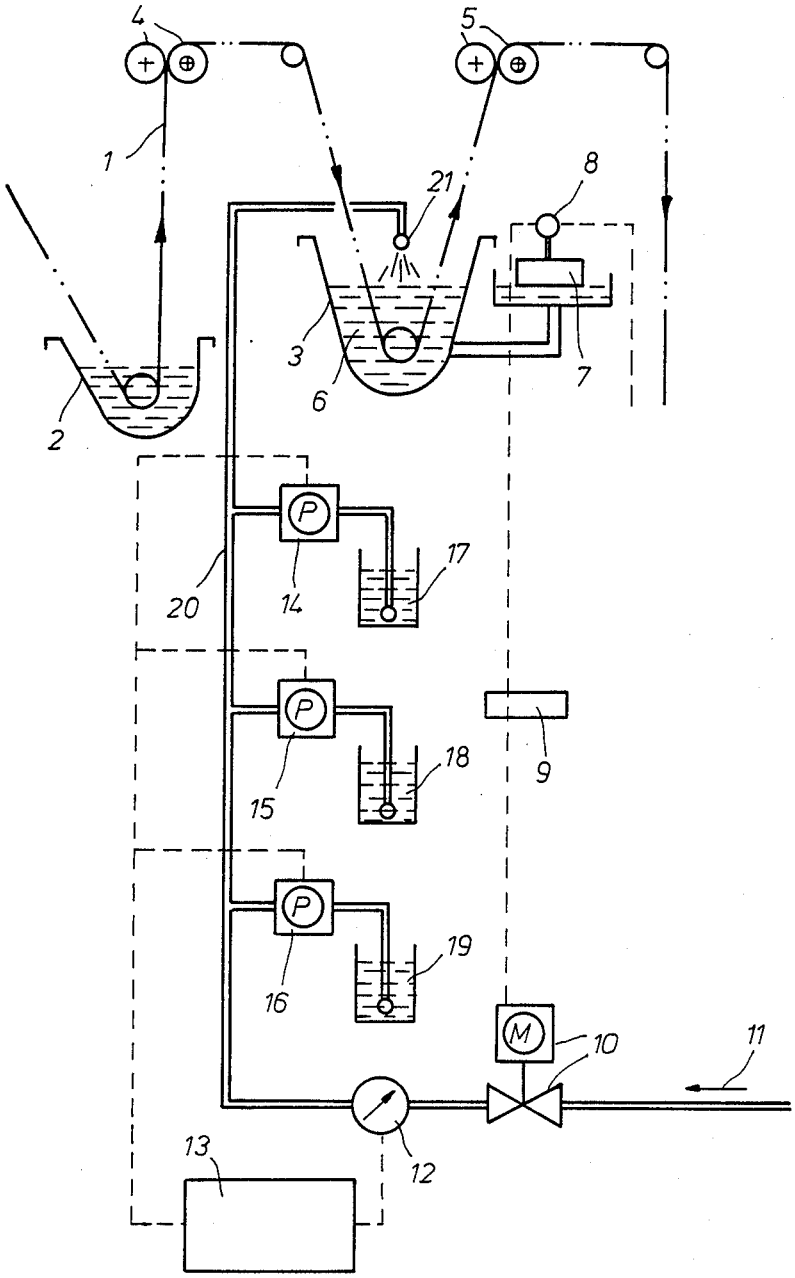
4
5
1
21
8
3
6
7
2
P
17
20
14
P
18
9
15
P
19
16
M
10
11
12
13

METHOD AND APPARATUS FOR CONTINUOUS WET-IN-WET PROCESSING

BACKGROUND OF THE INVENTION

The invention relates to a method and apparatus for continuous wet-in-wet processing of a length of material as the material is progressively advanced along its length through separate treatment baths. More particularly, the invention comprises the use of a low liquid volume treatment bath which is continuously regulated with additional dosages of chemicals and other preparations.

Wet-in-wet processing should be understood to mean a continuous process in which a length of material, for example a length of textile material, in cut form, in a hank or as a tube, passes through at least two baths or impregnating boxes.

In order to achieve a defined quantity of chemicals, softeners, dye liquors etc. to be applied, attempts have been made to obtain the most accurate difference possible in the moisture content in the length of material using squeezing apparatus or suction arrangements. For this purpose the length of material has as much water as possible removed from it after a first wet processing stage. After the water removal the length of material runs through a dipping tank, an impregnating box or other wetting arrangement, is wetted or soaked with the appropriate liquor and then again brought (by squeezing apparatus or by suction) to a quite specific residual moisture content which in this case must be higher than the moisture content on entering the wetting arrangement. The inlet moisture content can for example be 100% and the outlet moisture content 130%.

The differential moisture content (which in the given example is therefore 30%) must be introduced into the treatment bath by additional dosaging, and all the chemicals and preparations necessary for the desired treatment process must also be contained in this additional dosaging.

In the past there were essentially two methods for the additional dosaging.

The first method uses computers or manual arrangements which determine the weight of the material and the speed of the machine and regulate the additional dosaging accordingly. This method is very costly and difficult to control because of the continuously changing material widths and the differences in the composition and the weight of the particular type of material.

The second method operates on the "carrying off" principle. In this way the liquor level is kept as nearly constant as possible and the additional dosaging is controlled accordingly. However, with this method there are two opposing requirements which are difficult to reconcile.

On the one hand, the smallest possible quantity of liquor is desired (i.e. a small box content) in order to balance the intake and discharge rapidly. The incoming material brings with it for example 100% water (residual moisture) and undissolved preparations which to some extent dissolve in the bath and are mixed together; however, at the same time in this hypothetical example 130% is discharged. The 30% differential moisture content is added by means of a level control and contains all the chemicals and preparations necessary for this process. It will be clear that in this case a small quantity of liquor, i.e. a small box content, is a great advantage since a balance is achieved after a short time (since the outgoing material also carries off dissolved dirt and water).

On the other hand, the additional dosaging has in the past taken place intermittently, being switched on when the theoretical level is reached and switched on again when the level falls below the theoretical level. This results in more or less great surges in level and fluctuations in concentration, since in the interval in which liquor is not dosaged the bath is diluted with introduced water and at the next moment, when dosaging again occurs, increases in concentration. An even treatment, for example, impregnation, of the length of material is not possible in this way.

If by contrast a higher bath content is used, this results in an advantageous buffer effect and the aforementioned fluctuations in concentration do not occur to a marked degree. However, in this case the differences in level are difficult to detect and the dosaging surges take place at greater intervals. This results in the additional disadvantage that the state of balance is achieved considerably later and a larger quantity of waste liquor must be expected in the event of process alterations.

SUMMARY OF THE INVENTION

The object of the invention, therefore, is to avoid these disadvantages and to provide a method for maintaining the bath concentration constant with greater accuracy and at the same time the balance is achieved quickly.

In the method according to the invention a continuously regulated additional dosaging is achieved using a treatment bath of low content, so that the quantity of liquor added is always exactly the quantity which has just been carried off by the outgoing length of material.

Thus the method according to the invention combines the advantages of a small quantity of liquor, i.e. a low box content, with the merits of continuously regulated additional dosaging. In this way on the one hand the state of balance is achieved quickly at the beginning of the treatment process and only a small quantity of waste liquor is produced in the event of process alterations. On the other hand the continuously regulated additional dosaging ensures that a constant bath concentration is maintained and thus ensures an excellent quality, particularly uniformity, of the wet-in-wet processing.

BRIEF DESCRIPTION OF THE DRAWINGS

One embodiment of apparatus for carrying out the method according the invention is illustrated schematically in the drawing.

DETAILED DESCRIPTION

The illustrated apparatus for continuous wet-in-wet processing of a length of material 1 contains a first treatment bath 2 and a second treatment bath 3 through which the length of material 1 passes in succession. After the length of material 1 has passed through the treatment bath 2 it is brought by means of squeezer rollers 4 to a certain residual moisture content (for example 100%) which at the same time represents the inlet moisture content FE of the length of material as it enters the treatment bath 3.

The length of material 1 leaving the treatment bath 3 is brought by means of squeezer rollers 5 to a certain residual moisture content (for example 130%) which thus represents the outlet moisture content FA (based on the treatment bath 3).

The treatment bath 3 is filled with liquor 6, the level of which is monitored by a float 7 of relatively large volume. This float 7 equalises mechanical resistances and foaming and actuates a potentiometer 8 which is connected to an arrangement 9 for comparison of the theoretical value and the actual value.

A regulable motor valve 10 through which the quantity of fresh water (arrow 11) to be added is dosaged is connected to the arrangement 9.

The quantity of water flowing through the motor valve 10 is measured by a water meter 12 to which a microprocessor 13 is connected. This microprocessor 13 determines the quantity of additional substances (chemicals, preparations, etc.) to be added to the particular quantity of water. Accordingly a number of dosaging pumps 14, 15, 16 are connected to the microprocessor 13 and introduce the necessary quantities of additional substances from storage vessels 17, 18, 19 into the water pipe 20 which leads to a nozzle 21 through which the additional dosaging takes place.

In order to take account of differences in the method and the machinery, a factor 5 which is formed by the quotients of outlet moisture content FA and differential moisture content (FA-FE) is considered in the microprocessor 13.

The content of the treatment bath is advantageously so small that by means of the additional dosaging a complete liquor change takes place within 5 to 10, preferably within 10 to 15 minutes. With a production rate of 1000 kg of material per hour and a moisture difference of 30% the box content should not be more than 50 to 75 l.

While the invention has been described in detail with respect to a preferred embodiment thereof, it will be understood by those skilled in the art that various changes and modifications may be made without parting from the spirit and scope of the invention, and the invention is defined by reference to the following claims.

I claim:

1. Method of continuous wet-in-wet processing of a length of material (1) which has a certain inlet moisture content (FE) when it enters a treatment bath (3) filled with liquor and leaves this bath with an outlet moisture content (FA) which is higher than the inlet moisture content, and additional dosaging of treatment liquor is carried out in order to maintain the liquor level in the treatment bath (3), characterised in that using a treatment bath (3) of low content a continuously regulated additional dosaging is carried out in which the quantity of treatment liquor (6) added is exactly the quantity which has just been carried off by the outgoing length of material (1).

2. Method as claimed in claim 1, characterised by the following steps:

(a) by means of a float (7) which monitors the liquor level a quantity of water corresponding to the quantity of liquor just carried off is dosaged through a regulable valve (10);

(b) the quantity of water added is measured and the measurement obtained is fed into a microprocessor (13);

(c) the microprocessor (13) controls dosaging pumps (14, 15, 16) by means of which a quantity of additional substances corresponding to the liquor composition is dispensed into the added quantity of water.

3. Method as claimed in claim 1, characterised by the use of a treatment bath (3) the content of which is such that as a result of the additional dosaging a complete liquor change takes place in the treatment bath within 5 to 20, preferably 10 to 15 minutes.

4. Apparatus for continuous wet-in-wet processing of a length of material (1), containing (a) a treatment bath (3) in which the length of material (1) enters with a certain inlet moisture content (FE) and leaves with an outlet moisture content (FA) which is higher than the inlet moisture content;

(b) arrangements for additional dosaging of treatment liquor (6).

characterised by the following elements of the arrangements for additional dosaging of treatment liquor:

($b_1$) a float which monitors the liquor level, ($b_2$) a potentiometer (8) actuated by the float (7), ($b_3$) an arrangement (9) for comparing the theoretical and actual values which is connected to the potentiometer (8), ($b_4$) a regulable motor valve (10) which is connected to the arrangement (9) for comparing the theoretical and actual values and serves for dosaging of the added quantity of water, ($b_5$) a water meter (12) to measure the quantity of water flowing through the motor valve (10).

($b_6$) a microprocessor (13) connected to the water meter (12) to determine the quantity of additional substances to be added to the quantity of water, ($b_7$) dosaging pumps (14, 15, 16) connected to the microprocessor (13) for dosaging of the additional substances.

5. A method of continuous wet-in-wet processing of a length of material which includes the steps of advancing the material along its length through a first treatment bath, reducing the moisture content of the material as the material moves away from the first treatment bath, and advancing the material through a second treatment bath, characterized by the steps of controlling the moisture content of the material as the material moves away from the second treatment bath to a higher moisture content of the material than after the reduction of moisture content at the first treatment bath, and maintaining the volume of liquor of the second treatment bath constant by replenishing the liquid in said second treatment bath with a quantity of fresh liquid equal to that carried off by the material advancing through the second treatment bath, the total quantity of liquid in said second bath being such as to achieve a complete liquor change over the second treatment bath within five to twenty minutes.

6. The process of claim 5 and wherein the step of maintaining the volume of liquor of the second treatment bath achieves a complete liquor change over within ten to fifteen minutes.

* * * * *